US006131864A

United States Patent [19]

Schumann

[11] Patent Number: 6,131,864

[45] Date of Patent: Oct. 17, 2000

[54] HOLDING DEVICE

[75] Inventor: Jörn Schumann, Reinbek, Germany

[73] Assignee: Beiersdorf AG, Hamburg, Germany

[21] Appl. No.: 09/132,396

[22] Filed: Aug. 11, 1998

[30] Foreign Application Priority Data

Aug. 14, 1997 [DE] Germany ..... 197 35 228

[51] Int. Cl.[7] ..... A47G 1/17; F16B 45/00

[52] U.S. Cl. ..... 248/205.3; 248/304; 248/307

[58] Field of Search ..... 248/225.11, 227.1, 248/290.1, 294.1, 205.3, 304, 307

[56] References Cited

U.S. PATENT DOCUMENTS

| | | | |
|---|---|---|---|
| 1,930,965 | 10/1933 | Christy | 248/48 |
| 3,637,181 | 1/1972 | Janssen | 248/205 |
| 4,024,312 | 5/1977 | Korpman . | |
| 4,308,961 | 1/1982 | Kunce | 211/94.5 |
| 4,923,159 | 5/1990 | Wang et al. | 248/205.3 |
| 5,409,189 | 4/1995 | Lühmann | 248/205.3 |
| 5,491,012 | 2/1996 | Lühmann et al. . | |
| 5,507,464 | 4/1996 | Hamerski et al. | 248/683 |
| 5,626,931 | 5/1997 | Lühmann . | |
| 5,626,932 | 5/1997 | Lühmann et al. . | |
| 5,725,923 | 3/1998 | Lühmann . | |

FOREIGN PATENT DOCUMENTS

| | | |
|---|---|---|
| 33 31 016 C2 | 10/1984 | Germany . |
| 37 14 453 C1 | 4/1987 | Germany . |
| 42 22 849 C1 | 7/1992 | Germany . |
| 42 33 872 C2 | 3/1994 | Germany . |
| 43 39 604 C2 | 5/1995 | Germany . |
| 44 28 587 C2 | 2/1996 | Germany . |
| 44 31 914 C2 | 3/1996 | Germany . |
| 195 11 288 C2 | 10/1996 | Germany . |
| 92/11332 | 7/1992 | WIPO . |
| 92/11333 | 7/1992 | WIPO . |
| 94/21157 | 9/1994 | WIPO . |
| 95/06691 | 3/1995 | WIPO . |

*Primary Examiner*—Ramon O. Ramirez
*Assistant Examiner*—Jerome A. DeLuca
*Attorney, Agent, or Firm*—Norris, McLaughlin & Marcus, P.A.

[57] ABSTRACT

Holding device, comprising a one-part hook body and a one-part baseplate, the baseplate for the bond with an adhesive strip which releases on pulling being designed such that a grip tab of the adhesive strip protrudes beyond the baseplate, the hook body being designed such that it covers over the baseplate and also the grip tab protruding beyond the latter, characterized in that a) on the baseplate there is a formation, in which b) at least one spring element is fastened and which c) has a projection in the collar region, and in that in the hook body there are formed guides in which the projection of the formation of the baseplate is guided such that a) the hook body and the baseplate are undetachably bonded to each other, b) the hook body is released by a movement parallel to the baseplate from the basic position, in which the hook body is anchored on the baseplate and thereby covers over the baseplate and the grip tab of the adhesive strip, and is displaced parallel to the baseplate and c) the spring element can be used to turn the hook body by up to 90°, so that d) access to the grip tab is possible.

7 Claims, 8 Drawing Sheets

HOLDING DEVICE

The invention relates to a holding device which, by means of adhesive strips which release on pulling, is reversibly bondable and reusable, possibly with a new such adhesive strip.

Adhesive strips which release on pulling are commercialized as "tesa Power-Strips" by Beiersdorf AG and are also described by numerous patents, such as DE 33 31 016 B1, DE 42 22 849 B1, DE 43 39 604 B1, DE 44 28 587 B1 and DE 44 31 914 B1. In addition, U.S. Pat. No. 4,024,312, WO92/11332, WO92/11333 and WO95/06691 describe adhesive strips of this kind. Such adhesive strips are pulled out of the bond in the direction of the bond joint, in a way comparable with the opening of a preserving jar.

For instance, U.S. Pat. No. 4,024,312 describes a pressure-sensitive adhesive tape having extensible and elastic backing composed of a block copolymer, in particular for applications in the medical area, where painless pulling of the skin is desirable.

Furthermore, DE 33 31 016 A1 describes an adhesive film for re-releasable adhesive bonds which allows an adhesive bond established therewith to be released by pulling on the adhesive film in the direction of the bonding plane. With such adhesive films, high adhesive forces and shear strengths can be achieved and adhesive bonds can be released again without further aids, in a way comparable to the opening of a preserving jar, similar to the way in which there the rubber seal is pulled by the grip out of the seal joint.

Furthermore, DE 37 14 453 C1 describes a practice explosive charge which can be detached again from practice objects without destroying it and is reversibly fastened by such an adhesive film.

WO 92/11333 also describes, inter alia, adhesive films for corresponding applications, the adhesive films used having a low elasticity with at the same time high extension.

DE 42 22 849 C1 likewise describes a strip of an adhesive film of this kind with a specially shaped grip tab.

In addition, hooks or similar fastening systems for use together with such adhesive strips are commercially available as "tesa Power-Strips mit Haken" [with hooks] or else "tesa Power-Strips Systemhaken" [system hooks] from Beiersdorf AG.

Finally, DE 42 33 872 C2, DE 195 11 288 B1 and WO 94/21157 describe re-releasable self-adhesive hooks which are likewise provided with such adhesive films and are also re-releasable.

However, the adhesive systems and hooks represented in the above-mentioned publications also have a number of disadvantages:

Problems with hooks and the like of the prior art are, on the one hand, the visual concealment of the grip tab, which for the subsequent pulling must protrude beyond the device, and, on the other hand, the protection of this grip tab against manipulation or damage, including in particular damage by UV light.

Also, a multi-part design, as disclosed by the prior art, is disadvantageous whenever one part is lost or falls down, for instance during assembly. This risk increases the smaller the hooks are in their dimensions.

The object of the invention was to remedy this situation and, in particular, to provide a hook or the like which does not have the disadvantages of the prior art, or at least not to the same extent.

The invention relates accordingly to a holding device, especially a hook, as characterized in detail in the claims. The embodiments according to the subclaims are preferred.

The holding device according to the invention comprises a one-part hook body and a one-part baseplate, the baseplate for the bond with an adhesive strip which releases on pulling being designed such that a grip tab of the adhesive strip protrudes beyond the baseplate. The hook body is designed such that it covers over the baseplate and also the grip tab protruding beyond the latter.

On the baseplate there is a preferably circular formation. Fastened in the formation is at least one spring element. In the upper region, the formation has a peripheral collar.

Furthermore, in the hook body there are formed guides in which the projection of the formation of the baseplate is guided such that the hook body and the baseplate are undetachably bonded to each other. Furthermore, the hook body is released by a movement parallel to the baseplate from the base position, in which the hook body is anchored on the baseplate and thereby covers over the baseplate and the grip tab of the adhesive strip, and is displaced parallel to the baseplate. The spring element can be used to turn the hook body by up to 90°, so that access to the grip tab is possible.

In a preferred embodiment, the hook body is lifted by the spring element during the movement parallel to the baseplate.

The hook body and/or the baseplate are preferably produced from metal or plastic, most preferably polyethylene terephthalate, polystyrene or ABS.

The hook body advantageously has border regions which laterally enclose and visually conceal the baseplate and the adhesive strip to be adhesively attached behind the latter.

Finally, the holding device has an adhesive strip adhesively attached behind the baseplate.

With the aid of the holding device according to the invention, the disadvantages known from the prior art are avoided in an outstanding way.

No part of the holding device can be lost.

The hook body may also be used for grasping during the stripping operation.

Furthermore, a material mix is possible in the case of the hook body and baseplate, i.e. an optimum selection of the materials according to the application is possible.

The basic principle of the releasing operation of this holding device is that the hook body which is seated on the baseplate, and thereby covers the latter completely, is displaced and rotated in order in this way to give free access to the adhesive strip.

Particularly advantageous embodiments of the holding device according to the invention are presented in more detail below with reference to several figures, without wishing to restrict the invention unnecessarily by doing so.

Figure 5:
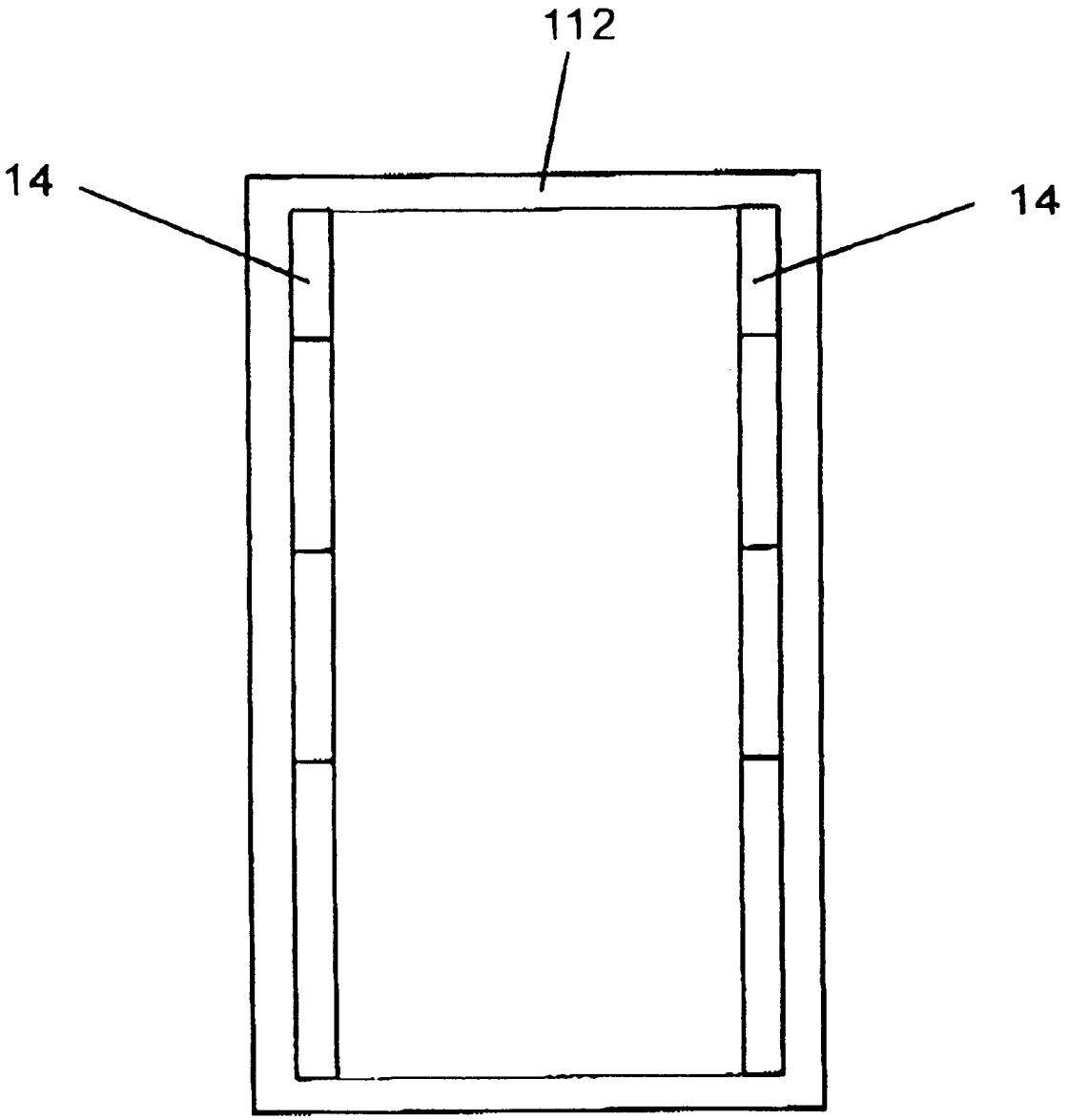

FIG. 5 shows two guides 14 under plate 111 surrounded by border 112.

Figure 6:
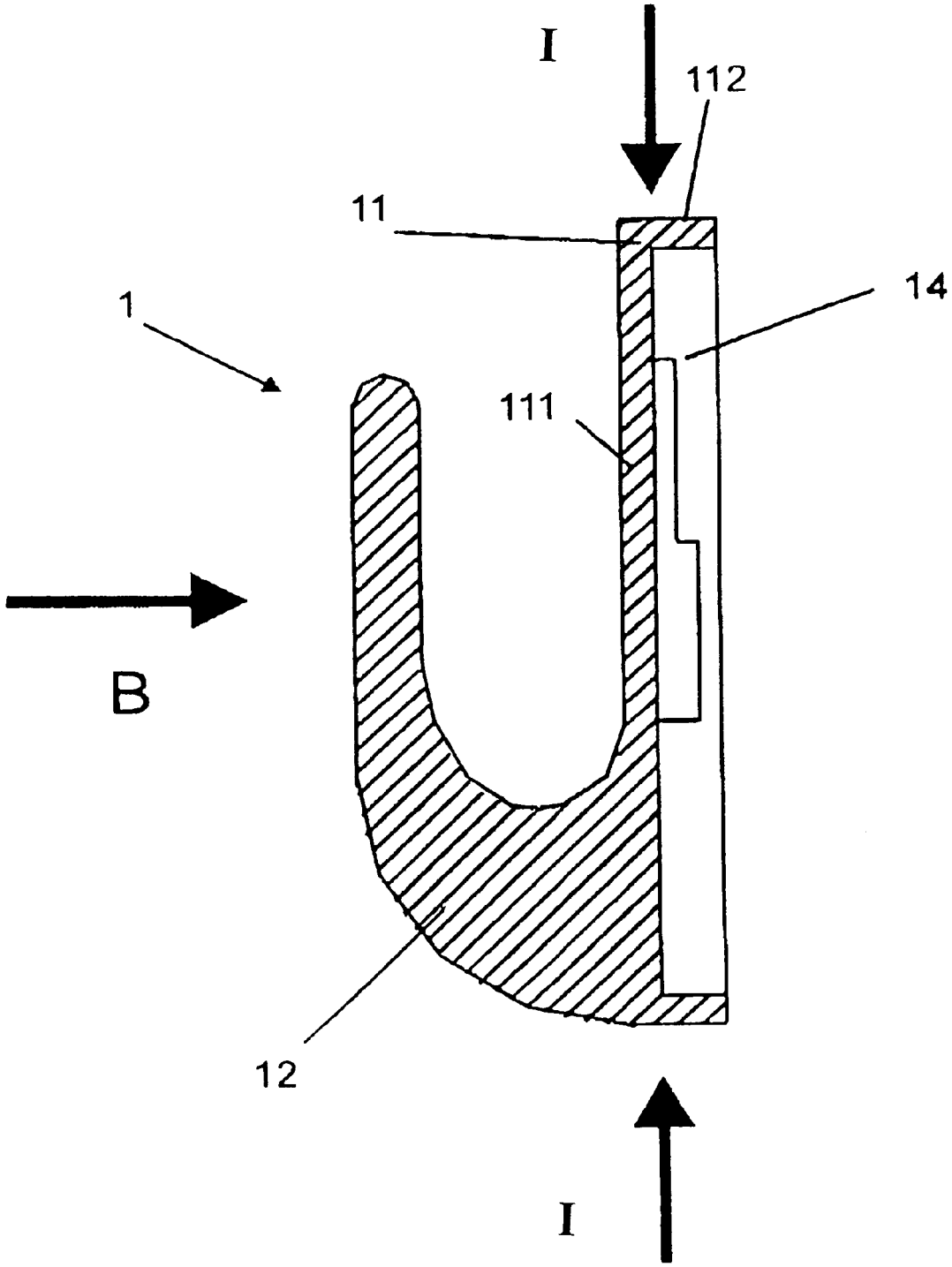

FIG. 6 shows the body of the holding device in lateral view, with view section I—I indicated, and sight direction B indicated.

Figure 7:
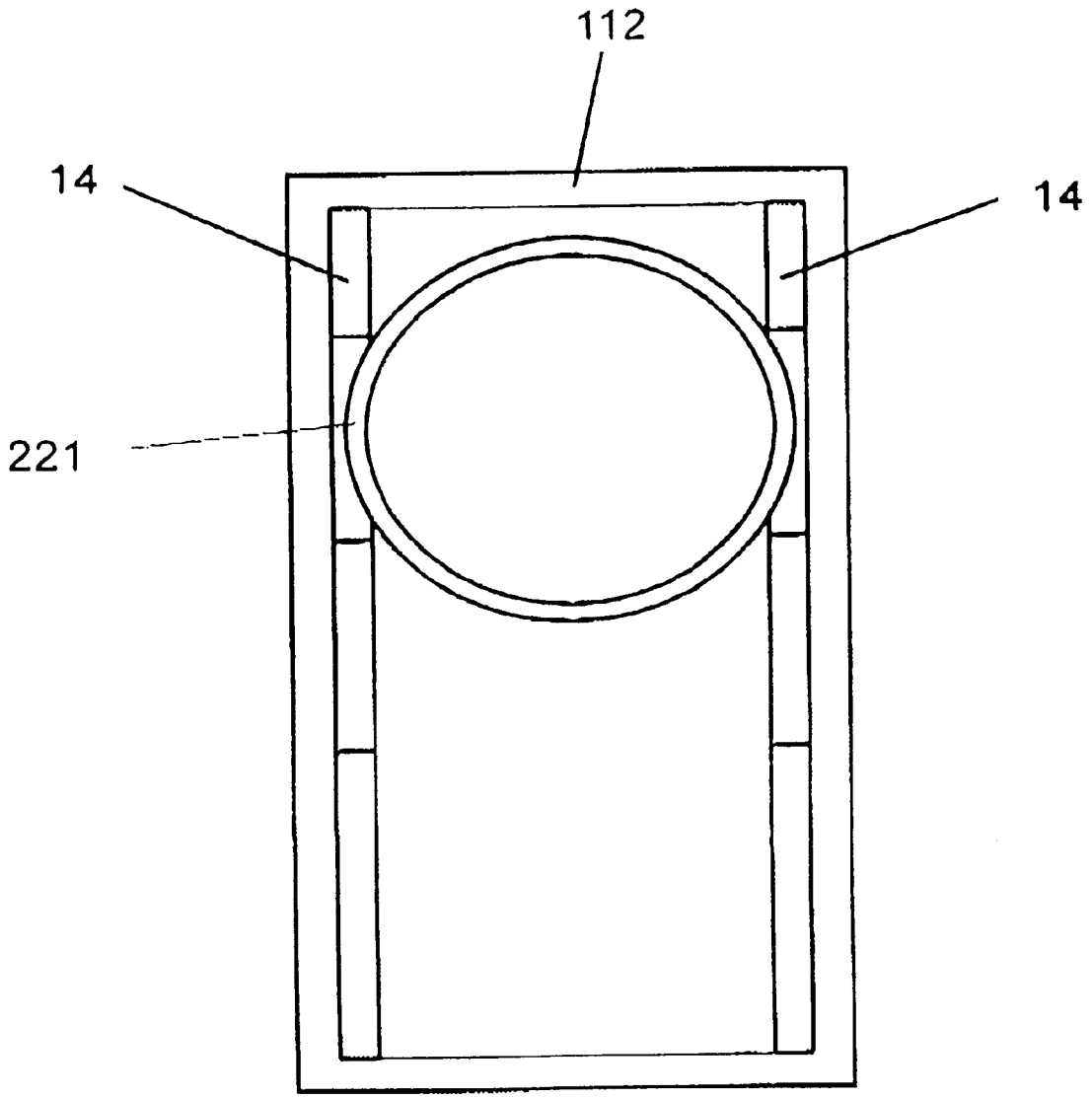

FIG. 7 shows collar 221 clamped between guides 14 and plate 111.

Figure 8:
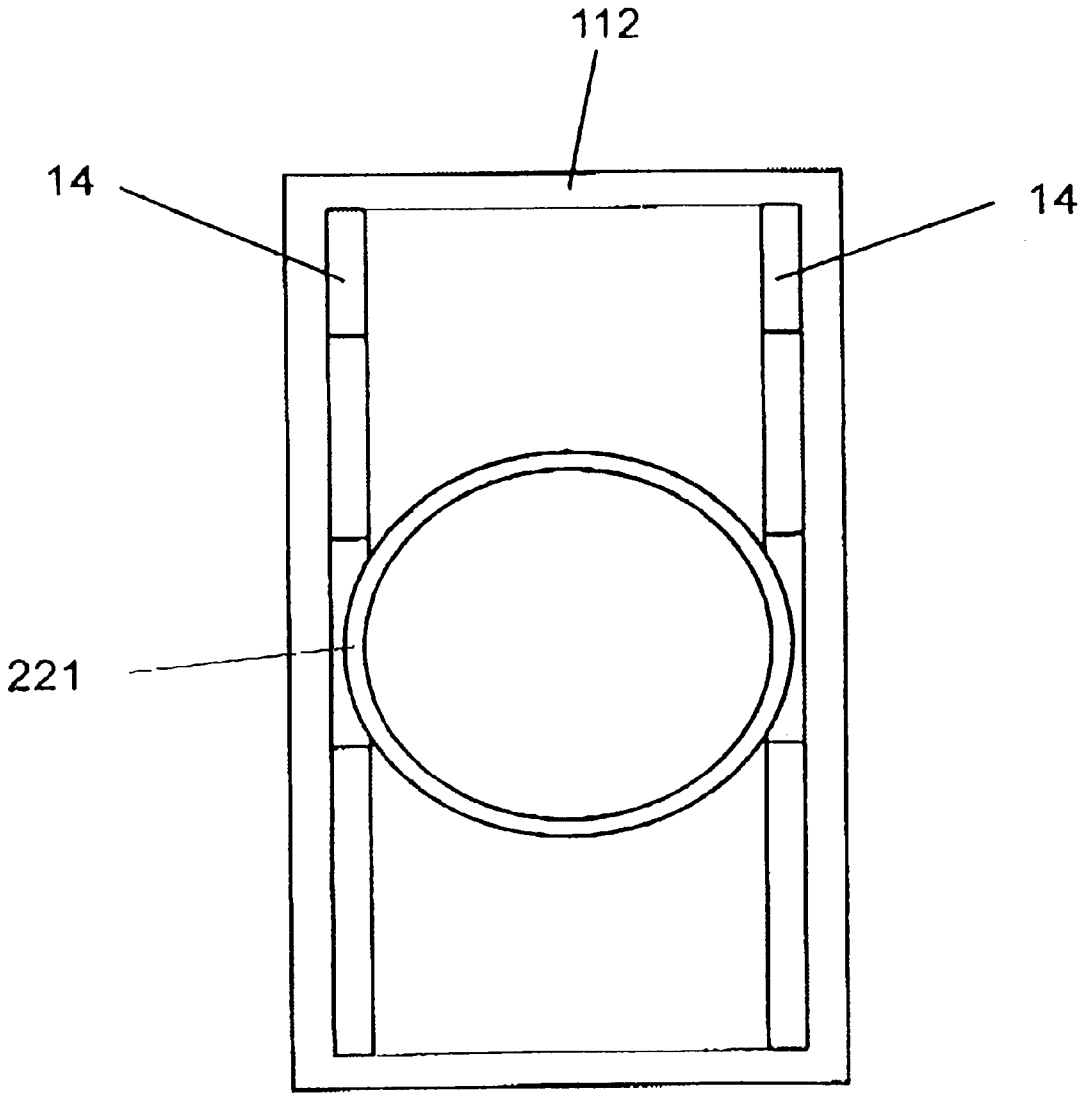

FIG. 8 shows collar 221 unclamped on the enlarged intermediate space of guide 14.

Figure 1:
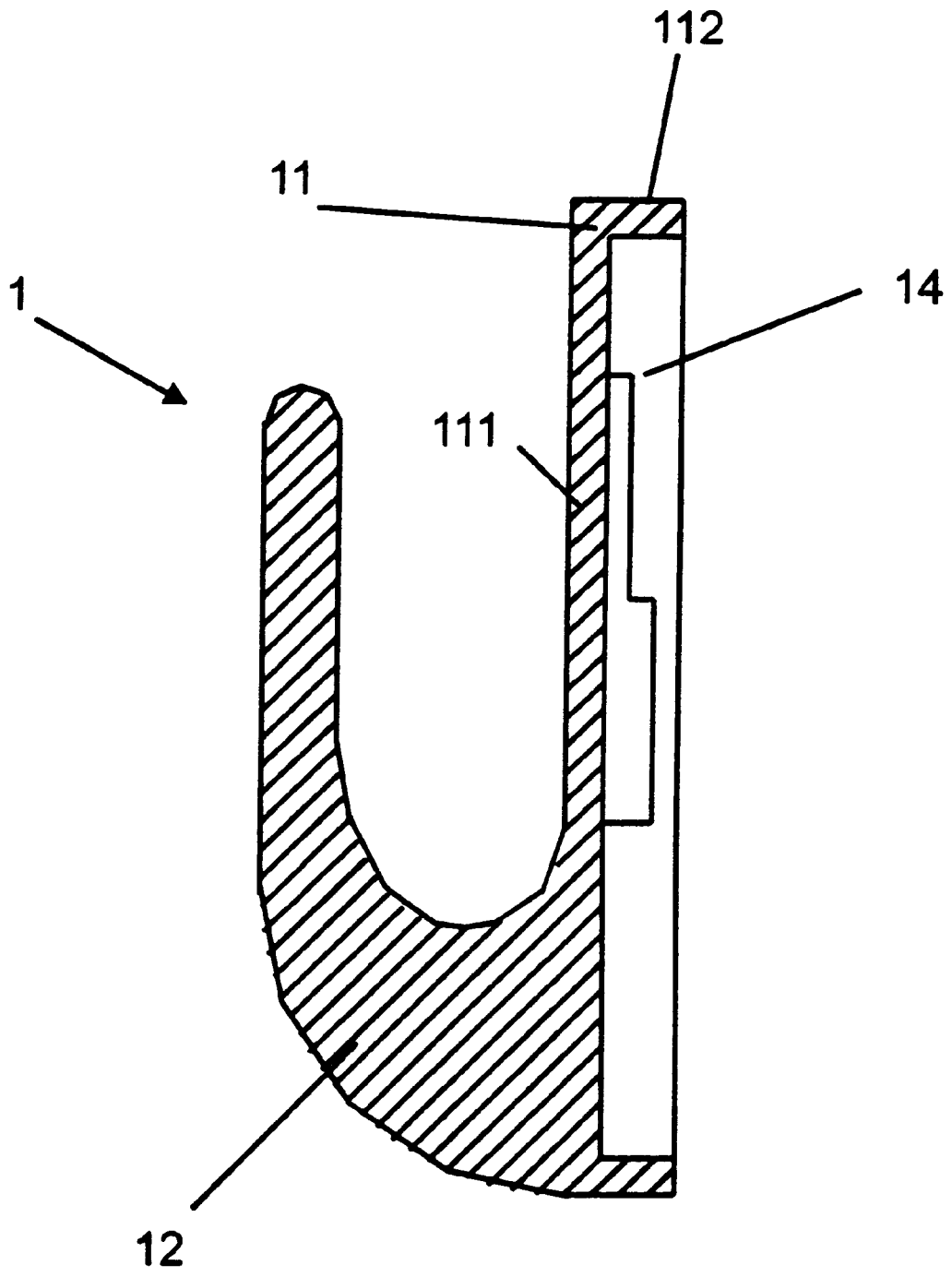
FIG. 1 shows the hook body of the holding device in lateral view.

In FIG. 1, the hook body 1 of the holding device is represented in a lateral section. The hook wall 11 of the hook body 1 comprises a preferably rectangularly shaped plate 111, which is completely surrounded by an overhanging border 112. Underneath the plate 111 are a total of two identically formed guides, by means of which the baseplate 2 is guided in the hook body 1 and of which one guide 14 is represented.

The guide 14 is adjacent to the border 112. Furthermore, the guide 14 terminates with the border 112, i.e. the guide 14 does not protrude beyond the outer edge of the border 112. The guide 14 begins at the upper region of the plate 111. In this region, the guide 14 extends over the entire height of the border 112. In the second portion, the guide 14 is then shaped such that there is formed between guide 14 and plate 111 an intermediate space, which serves for receiving the collar 221 of the extension 22 on the baseplate 2. In the third region of the guide 14, approximately in the centre of the plate 111, the intermediate space between the guide 14 and the plate 111 is enlarged. This is then followed again by a portion of the guide 14 in which the guide 14 extends over the entire height of the border 112. This region then proceeds as far as the lower part of the border 112.

On the hook wall 11, to be precise opposite the border 112, there is integrally formed a hook 12, which serves for receiving any desired items, for example items of clothing, towels etc.

Figure 2:
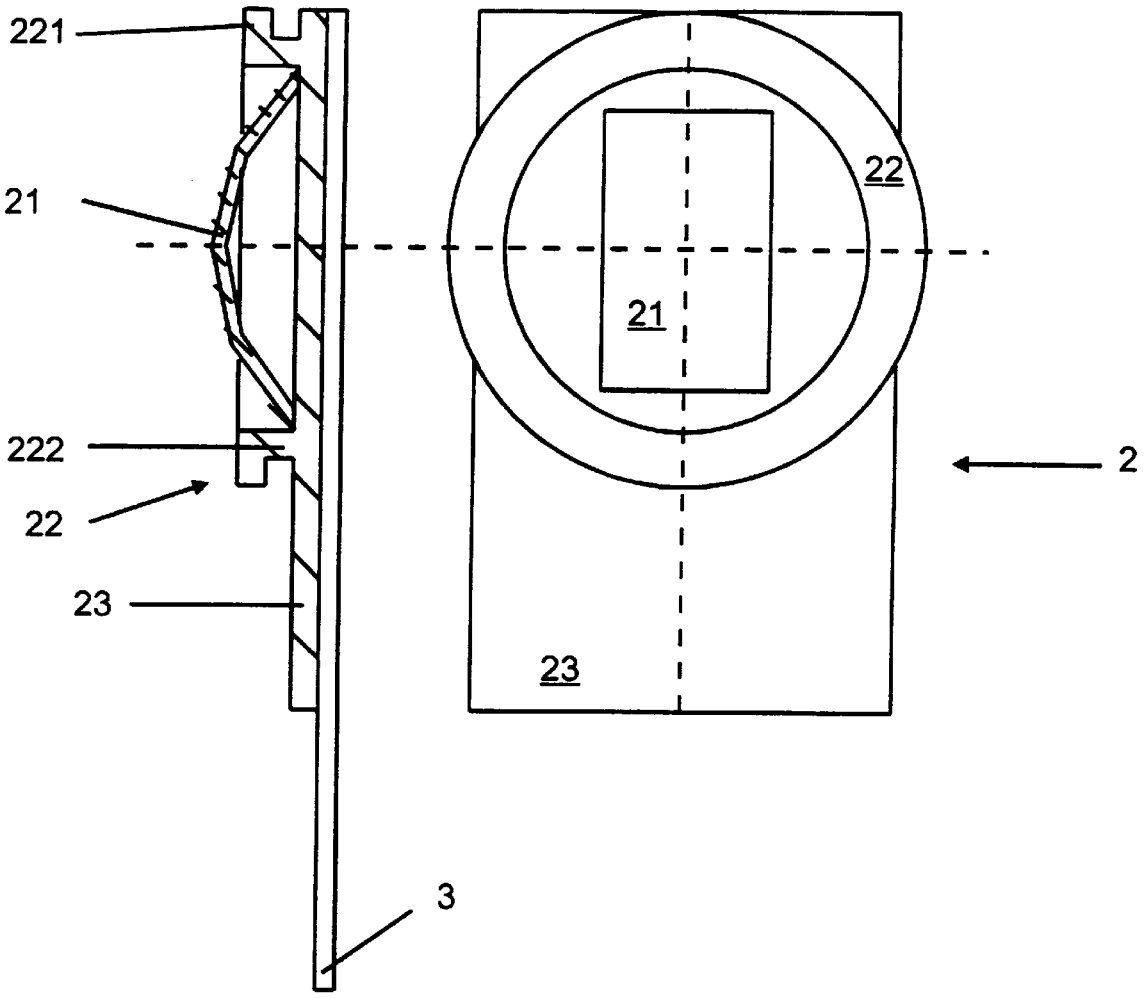
FIG. 2 shows the baseplate of the holding device with spring element in plan view and the baseplate bonded to an adhesive strip.

FIG. 2 shows the baseplate 2 and the baseplate 2 bonded by means of an adhesive strip 3 in lateral view, the protruding region of the adhesive strip 3 not being provided with adhesive, in other words forming a grip tab for the adhesive strip 3. The baseplate 2 comprises a substantially rectangularly shaped base 23, on which there is a formation 22. Fastened in the formation 22 is a spring element 21.

The formation 22 is annularly shaped and is located in the upper region of the base 23. On the ring 222 of the formation 22 there is a peripheral collar 221, which engages in the guides 14 of the hook body 1. In the relaxed state, the spring element 21, here in the form of a leaf spring, protrudes beyond the collar 221.

Figures 3A, 3B, 3C, 3D:
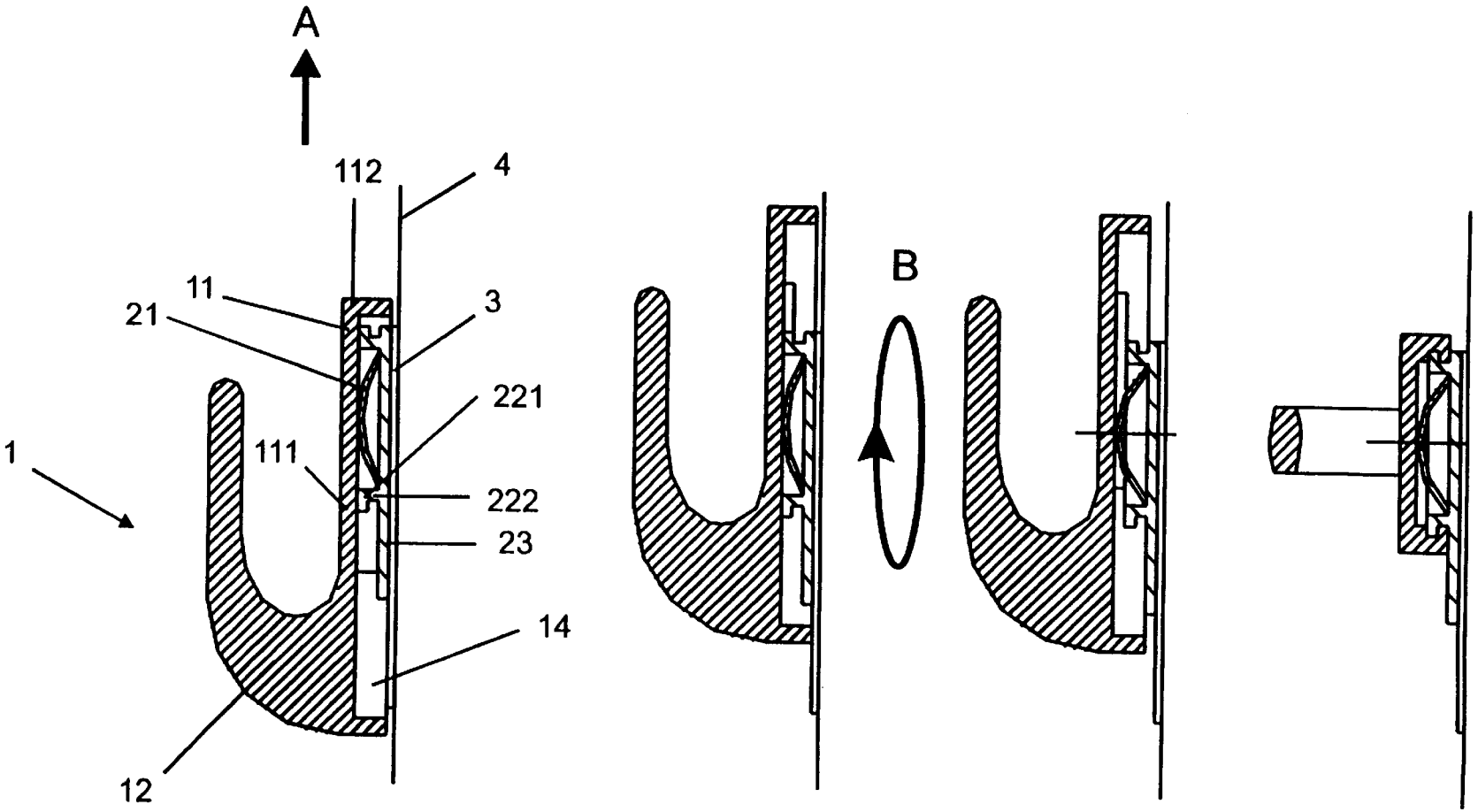
FIGS. 3*a* to 3*d* show the operation of releasing the holding device with the baseplate from FIG. 2, which has been adhesively attached on an underlying surface by means of an adhesive strip.

FIGS. 3*a* to 3*d* show the releasing operation of the holding device, comprising hook body 1 and baseplate 2, which are adhesively attached on an underlying surface 4, for example a tile, by means of the adhesive strip 3. In FIG. 3*a*, the holding device is in the permanently bonded state. For this purpose, the baseplate 2 is fixed by the adhesive strip 3. The hook body 1 has been pushed onto the baseplate 2 in such a way that the collar 221 of the formation 22 is clamped in the intermediate space between the guide 14 of the hook and the plate 111. At the same time, the spring 21 exerts a pressure on the hook body 1, the hook body is thus fixed in its position. The adhesive strip 3, together with the grip tab and the baseplate 2, are completely covered by the hook body 1.

Figure 4:
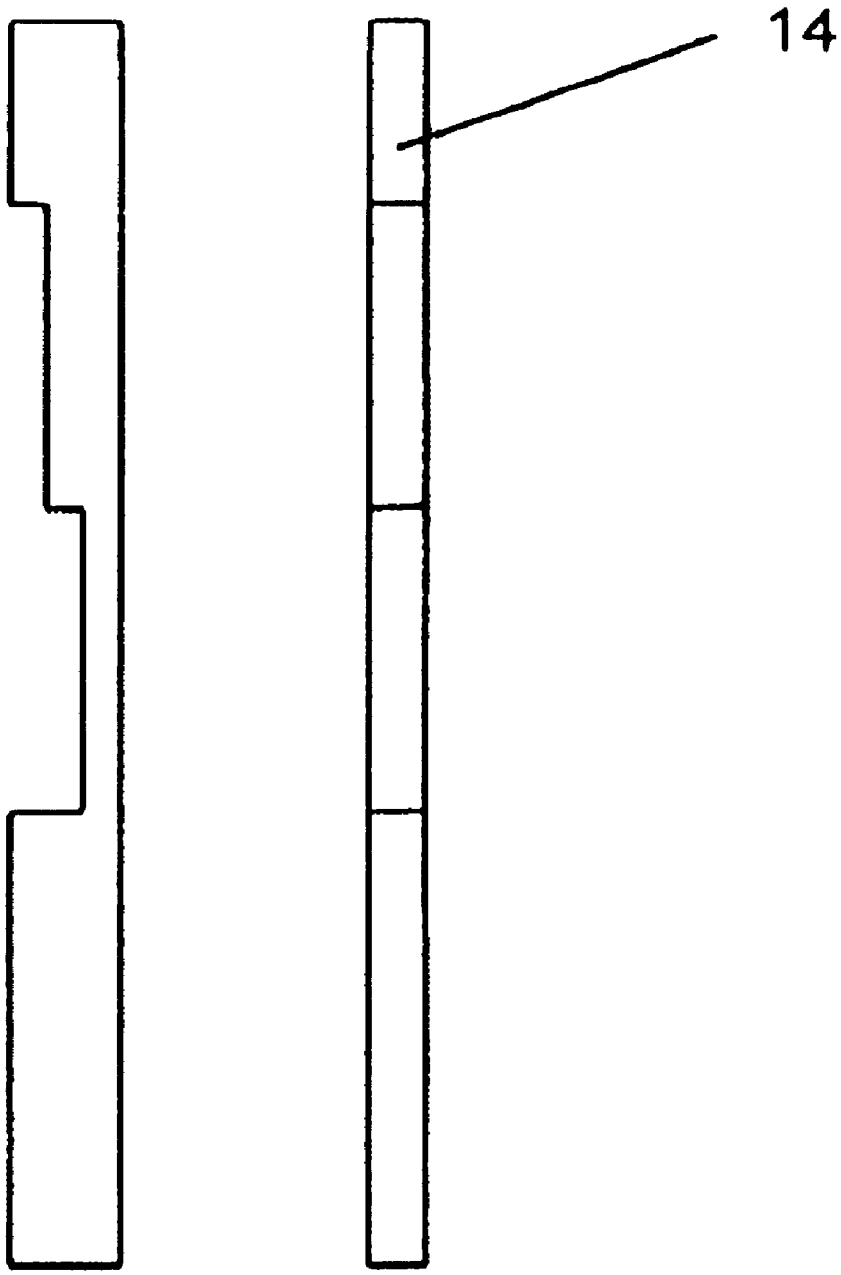
FIG. 4 shows the guide 14 in lateral view.

In FIG. 4, guide 14 can be seen in lateral view (left) and in view from above (right). There are two guides 14 under plate 11 (FIG. 5). If a cut is made in the direction of I—I, and section I—I is viewed in the direction of arrow B (FIG. 6), the view depicted in FIG. 5, showing two guides 14 under plate 111 surrounded by border 112 can be seen.

In FIG. 7, it can be seen that collar 221 is clamped between the guides 14 and plate 111, so that no movement of the hook is possible.

In FIG. 8, it can be seen that the hook body has been pushed vertically upwards, so that the larger space created when enlarged section of guide 14 (lower section as seen in FIG. 4) comes over collar 221, thereby leaving the hook body unclamped and free to rotate about collar 221.

For releasing the holding device from the wall, the hook body 1 is pushed vertically upwards, in other words parallel to the bonding plane, as indicated by the arrow A. The collar 221 slides out of the intermediate space between plate 111 and guide 14, the hook body 1 shifts into the region in which a movement upwards, perpendicular to the bonding plane is possible. The spring 21 causes the hook body 1 also to be pressed upwards. In this region, the hook can be rotated by altogether 90°, as indicated by the arrow B. This makes the grip tab of the adhesive strip freely accessible, the holding device can be removed from the underlying surface by pulling the adhesive strip 3 out of the bond, which leads to a reduction in the adhesive forces. At the same time, the adhesive strip 3 is, however, also detached from the baseplate 2, so that the holding device is likewise removed from the underlying surface and can be adhesively attached again to a reduction in the adhesive forces. At the same time, however, the adhesive strip 3 is also released from the baseplate 2, so that the holding device is likewise removed from the underlying surface and can be adhesively attached again.

I claim:

1. Holding device, comprising a one-part hook body and a one-part baseplate, the baseplate for the bond with an adhesive strip which releases on pulling being designed such that a grip tab of the adhesive strip protrudes beyond the baseplate, the hook body being designed such that it covers over the baseplate and also the grip tab protruding beyond the latter, a) on the baseplate there is a formation, in which b) at least one spring element is fastened and which c) has a projection in the form of a collar, and in the hook body there are formed guides in which the collar of the formation of the baseplate is guided such that a) the hook body and the baseplate are held to each other by said formation b) the hook body is alternately clamped or released by a movement of the hook body parallel to the baseplate whereby the hook body is, in a first position, anchored on the baseplate and thereby covers over the baseplate and the grip tab of the adhesive strip, and when displaced parallel to the baseplate to a second position becomes lifted away from the baseplate and unclamped and c) the hook body when in said second position can be rotated up to 90°, so as to d) uncover the grip tab.

2. Holding device according to claim 1, wherein said formation is circular.

3. Holding device according to claim 1, wherein the hook body is lifted off of the baseplate by the spring element during the movement of the hook body parallel to the baseplate from said first position to said second position.

4. Holding device according to claim 1, wherein the hook body further comprises a border which laterally encloses and visually conceals the baseplate and the adhesive strip.

5. Holding device according to claim 1, wherein the hook body, the baseplate or both are produced from metal or plastic.

6. The holding device of claim 5, wherein said hook body, said baseplate or both are produced from plastic and said plastic is selected from the group consisting of polyethylene terephthalate, polystyrene and acrylonitrile-butaclene-styrene.

7. Holding device according to claim 1, wherein the holding device comprises an adhesive strip adhesively attached behind the baseplate.

* * * * *